US005791514A

United States Patent [19]

Kirk, III et al.

[11] Patent Number: 5,791,514

[45] Date of Patent: Aug. 11, 1998

[54] MOTORIZED CANDY DISPENSER

[75] Inventors: Karl D. Kirk, III; Paul Mulhauser, both of New York; Diego Fontayne, Montebello, all of N.Y.

[73] Assignee: Cap Toys, Inc., Bedford Heights, Ohio

[21] Appl. No.: 599,076

[22] Filed: Feb. 9, 1996

[51] Int. Cl.[6] ..... G07F 11/00

[52] U.S. Cl. ..... 221/81; 221/155; 221/88; 221/281; 221/225; 221/232; 221/89

[58] Field of Search ..... 221/24, 76, 79, 221/81, 86, 88, 89, 281, 225, 232, 266, 75, 155

[56] References Cited

U.S. PATENT DOCUMENTS

| | | | |
|---|---|---|---|
| 1,300,608 | 4/1919 | Harris | 221/76 |
| 2,705,576 | 4/1955 | Amelio et al. | 221/232 |
| 3,533,536 | 10/1970 | Baxendale | 221/281 |
| 3,638,830 | 2/1972 | Belokin, Jr. | 221/246 |
| 4,485,765 | 12/1984 | Schwartz et al. | 119/51.13 |
| 4,903,861 | 2/1990 | Yuyama | 221/265 |
| 5,014,877 | 5/1991 | Roos | 221/265 |
| 5,044,516 | 9/1991 | Hoar | 221/2 |
| 5,133,292 | 7/1992 | Kirk | 119/51.04 |
| 5,246,136 | 9/1993 | Loidl | 221/3 |
| 5,337,920 | 8/1994 | Clausen | 221/76 |
| 5,535,916 | 7/1996 | Veltman | 221/76 |
| 5,603,429 | 2/1997 | Mulhauser et al. | 221/281 |

*Primary Examiner*—H. Grant Skaggs

*Attorney, Agent, or Firm*—Laff, Whitesel, Conte & Saret, Ltd.

[57] ABSTRACT

A dispenser having a housing for dispensing candies therefrom and having a rotatable raceway therein with a plurality of turntables disposed within the housing and on the raceway, with each of the turntables including a compartment sized to accommodate a candy to be dispensed, and a drive motor for driving the raceway and coupled to the turntables for rotating the turntables and for revolving the turntables within the housing to transport the candies to a dispensing station.

19 Claims, 6 Drawing Sheets

MOTORIZED CANDY DISPENSER

FIELD OF THE INVENTION

This invention relates generally to a device for dispensing an edible confection and in particular to an electrically operated dispenser, and is more particularly directed toward a hand-held, battery powered, motorized candy dispenser.

BACKGROUND OF THE INVENTION

In general, small candy confections, popular among youngsters, are simply dispensed from the package, such as a bag or roll of candies. The pastime of eating candy can be made even more attractive if the candies are dispensed by an apparatus having an amusement character.

Plastic candy dispensers are known for the popular rectangular candy known as PEZ. These plastic dispensers may include integrally-formed likenesses of fantasy characters, adding to their appeal to small children, and creating not a little interest among collectable-minded adults. These known plastic dispensers, however, are somewhat difficult to load with candy, and are entirely manual in operation.

Accordingly, a need arises for a motorized candy dispenser that is relatively easy to load with candy, that provides enhanced amusement value by virtue of its motorized operation, and that dispenses candies singly and in an undamaged condition.

SUMMARY OF THE INVENTION

These needs and others are satisfied by the motorized candy dispenser of the present invention. In accordance with the present invention a dispenser is provided, the dispenser comprising a housing for receiving objects to be dispensed and defining a station at which objects are to be dispensed from the housing, a plurality of turntables disposed within the housing, each of the turntables including a compartment sized to accommodate an object to be dispensed, and drive means operatively coupled to the turntables for rotating the turntables and for revolving the turntables within the housing to transport objects to the dispensing station. The housing desirably comprises a bottom shell and a top shell. The drive means includes a first gear in the bottom shell, and a raceway mounted to revolve within the bottom shell, the raceway providing a second gear disposed about its inner periphery and providing means for rotatably mounting the turntables for engagement with the first gear. The drive means may also include a drive motor and a gear train having a drive gear engaging the first gear for revolving the raceway, and wherein the second gear imparts rotational motion to the turntables to rotate the turntables while the raceway revolves within the housing interior.

In a preferred form the dispenser is motorized and comprises a bottom shell having a first gear disposed about its interior periphery, a top shell mating with the bottom shell to define therewith a housing interior, the top shell having a magazine mounted to its exterior surface for communication with the housing interior, the top shell having a circumferentially located discharge opening therein, a plurality of turntables within the housing interior, each of the turntables including a compartment sized to accommodate an article to be dispensed, drive means operatively coupled to the turntables for imparting rotational motion to the turntables and for revolving the turntables within the housing interior, and a discharge mechanism that discharges the objects from the turntable compartments through the discharge opening when the associated turntable revolves to the discharge opening.

The motorized dispenser of desirably includes a transfer means at a first end for transferring articles to the turntables, and the drive means comprises a first gear in the bottom shell, and a raceway mounted to revolve within the bottom shell, the raceway providing a second gear disposed about its inner periphery and providing means for rotatably mounting the turntables for engagement with the first gear, the drive means further comprising a drive motor and a gear train having a drive gear engaging the first gear for revolving the raceway, and wherein the second gear imparts rotational motion to the turntables to rotate the turntables while the raceway revolves within the housing interior.

In a preferred form the motorized dispenser has means for transferring articles, including a transfer barrel and a magazine, and wherein the magazine biases articles to the transfer barrel, and the transfer barrel is mounted to transfer articles received from the magazine downwardly into the housing and to the compartments, and wherein the housing defines a window and the means for discharging articles from the compartments comprises spring operated means for discharging articles through the window at a discharge station.

In a most preferred form the discharge mechanism provides means for forcibly ejecting articles serially from each compartment, the ejecting means comprising-spring operated means mounted in the housing and means on a raceway assembly for biasing the spring operated means between a first inactive position and a second active ejecting position and for releasing the spring operated means to forcibly eject an article in a compartment from the housing.

Further objects, features, and advantages of the present invention will become apparent from the following description and drawings.

DETAILED DESCRIPTION OF A PRESENTLY PREFERRED EMBODIMENT

Figure 1:
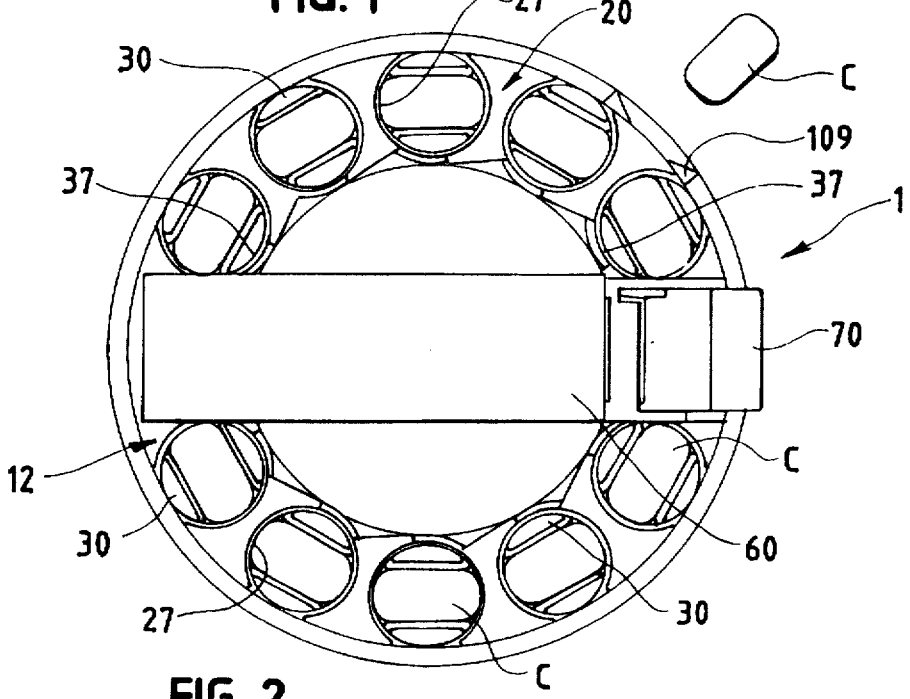
FIG. 1 is a plan view of a motorized dispenser of the present invention.

Referring now to the drawings, a battery operated motorized candy dispenser designed to sequentially dispense rectangular or other candies, such as PEZ candies, is provided.

In the illustrated embodiment, an entire package of twelve candies is intended to be loaded into a horizontal magazine atop the dispenser, and the candies are thereafter transferred one at a time to a set of twelve rotating carousels. The rotating candy carousels are visible through the transparent top cover. Individual candies transferred from the magazine at approximately the 12:00 noon position and are transported around the periphery of the dispenser, rotating all the while, until an individual candy is dispensed at the 10:30 position. The revolving and rotational motions are accomplished by use of a battery powered electric motor activated by a suitable switch, such as the triggering mechanism described below.

Figure 2:
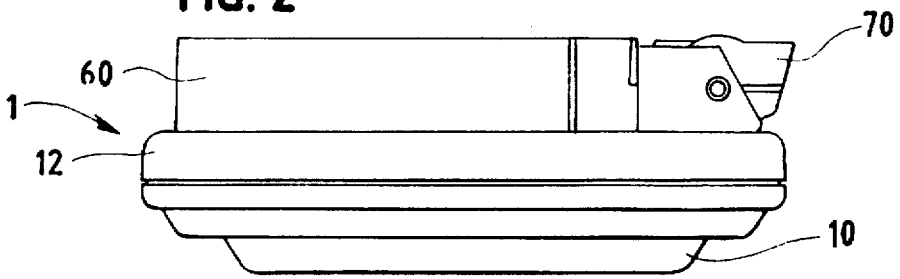
FIG. 2 is a side elevational view of the dispenser of FIG. 1 as viewed from the front side thereof.
Figure 3:
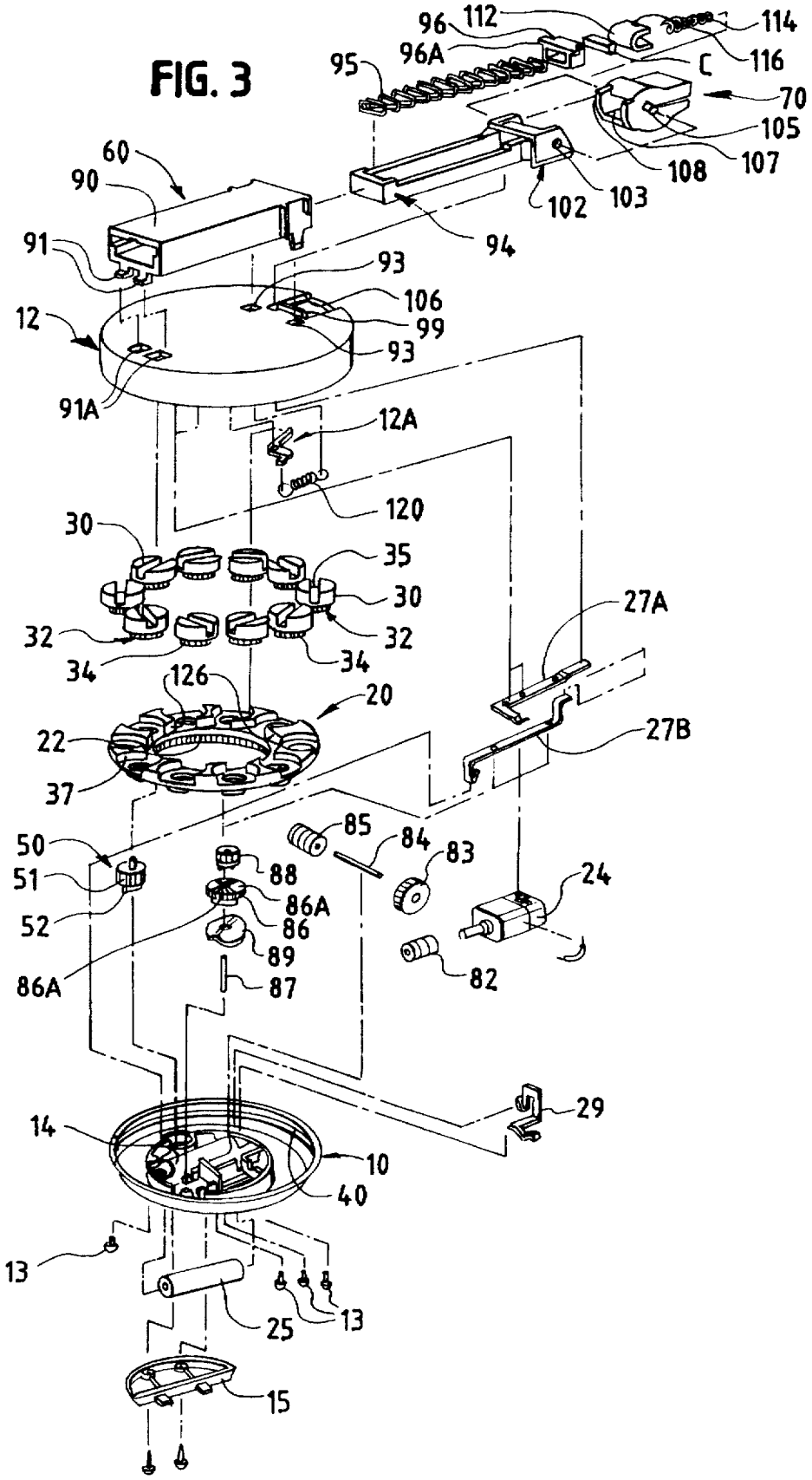
FIG. 3 is an exploded perspective view of the dispenser of FIG. 1.

Referring first to FIGS. 1 to 3, the dispenser 1 comprises a hollow housing for receiving objects such as candies to be dispensed. The housing has a bottom shell 10 and a top shell 12. Shells 10 and 12 are secured, as by screws 13 (FIG. 5 and 7) to form a permanent enclosure. The dispenser is adapted to be hand held and may be about four inches in diameter.

The bottom and top shells 10 and 12 enclose a raceway 20 which is adapted to be revolved continuously, as in a clockwise direction, within the housing. It is driven via a gear 22 integrally formed with the raceway and by a motor 24 and a gear train.

The motor 24 is powered by a battery 25. A negative contact 29 is provided and mounted in the bottom shell and a composite positive battery contact 27 comprising contact members 27A and 27B are suitably fixed in the bottom shell 10. As will be described later, the elements 27A, 27B are metal leaves and are positioned to be engaged by a rotating boss or protrusion 108 on a barrel 70 when the barrel is rotated.

The gear 22 may be a 32 pitch gear having 72 teeth and a twenty degree pressure angle. The raceway supports a plurality of turntables 30 for rotation thereon. Each table 30 is generally circular in plan view and has a depending stem 32 which is formed to define a gear 34 (See FIGS. 6 and 7). Gears 34 are positioned to engage and mesh with a continuous internal gear 40 integrally formed with the bottom shell 10.

Thus it will be clear that as the raceway 20 revolves in response to the driving of gear 22 by motor 24 (via the gear train 26), each of the turntables 30 will rotate, as the engagement of gears 34 with internal gear 40 requires.

The top shell 12 of dispenser 1 also mounts a magazine 60 for the rectangular candies C, such as PEZ candies, and is adapted to transfer candies to the housing and to load such candies, one at a time, onto the turntables 30. The candies C, as will appear, are advanced forwardly along the length of the magazine 60. At the front end of the magazine 60 a transfer mechanism or barrel 70 receives a candy piece and then is adapted to pivot so that the candy which advances to the barrel in a generally horizontal direction may be transferred downwardly, namely in a generally vertical direction relative to the magazine 60. The candy is then spring fed by the barrel 70 into a compartment 35 in an underlying turntable 30. Thereafter the candy is carried to an ejection station at which it is ejected from the housing.

Figure 4:
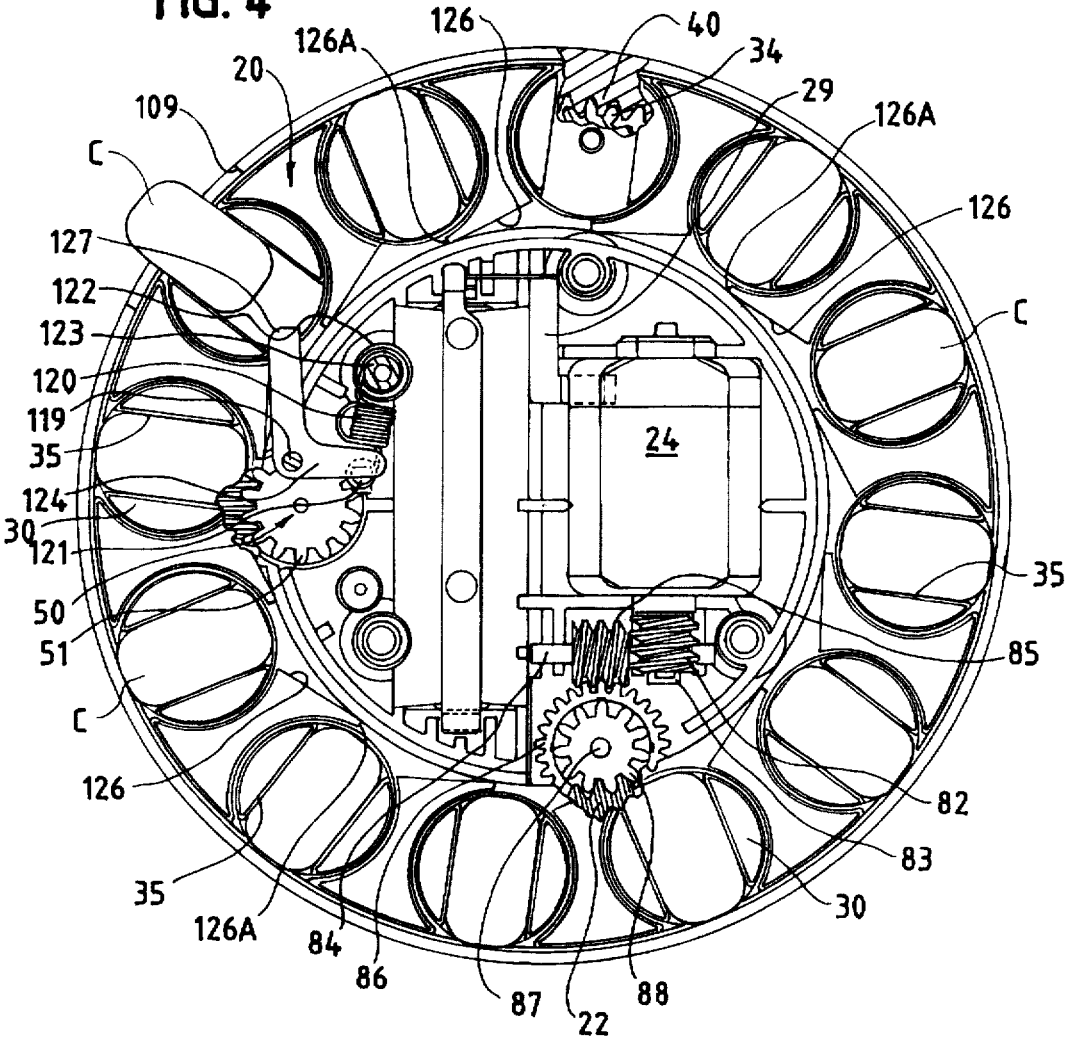
FIG. 4 is a plan view of the dispenser of FIG. 1, with some of the elements broken away and eliminated for ease of understanding.

Referring now to FIGS. 3 and 4, the drive mechanism for the dispenser 1 includes, as stated, the motor 24 and gear train 26. Motor 24 is a conventional battery operated motor adapted to be powered by a 1.5 volt AAA battery 25, such as an alkaline battery, which is housed in a compartment 14 in the bottom shell 10. The compartment is closed by a cover 15. Motor 24 is captured between the bottom shell 10 and the top shell 12.

The drive shaft of motor 24 mounts a worm 82 which engages worm gear 83. Worm gear 83 is supported for rotation on the shell 10 (see FIG. 5) and is coaxially and rotatably mounted with worm 85 on a drive shaft 84 to drive worm 85. Worm 85 engages and drives a master gear 86. Master gear 86 is mounted on a shaft 87, as is pinion gear 88, and is adapted to engage pinion gear 88. The surface of master gear 86 and the confronting surface of pinion gear 88 form a slip clutch. The slip clutch may comprise V-shaped cross-cuts 86A in the surface of master gear 86 which receive corresponding V-shaped projections which depend from the pinion gear 88. Gears 86 and 88 are held in engagement by a spring, such as a wave spring 89 which may be formed of stainless steel. If an overload condition develops, the master gear 86 and pinion gear 88 can slip and rotate relative to each other so that no damage to the mechanism or candies will occur.

Pinion gear 88 is positioned to engage the raceway gear 22 for driving the raceway 20. Thus, when master gear 86 and pinion gear 88 are in driven engagement and the motor 24 is in operation, the raceway 20 will revolve continuously in a clockwise direction. The raceway is held in its centered position relative to the internal gear 40 on the bottom shell 10 by the turntables 30.

As will be appreciated, as the raceway 20 revolves, the gears 34 of stems 32 of turntables 30 which are in engagement with the internal gear 40 will be caused to rotate in a counterclockwise direction. Thus any candies C seated in the compartments 35 defined by the upstanding arms (i.e., within the recesses formed between the arms of the turntables 30) will rotate. The compartments 35 are sized and configured to accommodate the particular objects to be dispensed. The gearing may be arranged such that the turntables 30 rotate 12 times during a single revolution of the raceway 20.

This is best seen in FIGS. 1, 4, 5 and 7, where the raceway 20 is shown to define means for rotatably mounting the turntables 30 for engagement with the internal gear 40. The turntable mounting means include a shaft 36 on which a turntable 30 is adapted to be seated and about which a turntable 30 may rotate within a surrounding recess 37. Shaft 28 is received within turntable stem 32. Table stem 32 is formed with a gear 34 which engages internal gear 40. Gear 34 may be a nine tooth gear having a 32 pitch and a 20 degree pressure angle. The outer diameter of the turntables 30 are 0.640 inch and the widths of the compartments 35 are about 0.356 inch.

The magazine 60 and transfer means or barrel 70 are shown in greater detail in FIGS. 3, 5, 6 and 7. Magazine 60 is removeably mounted to the top shell 12 and comprises a generally tubular cover 90 which lies along the top of the top shell 12. The magazine is removable to allow for cleaning and the like. Cover 90 is secured to the top shell 12 by tongue members 91 received in openings 91A in the shell 12 and by a pair of snap members 92 which are received in complementary openings 93 in top shell 12. A magazine drawer 94 is adapted to be received and retained in the cover 90 via retaining flanges 96A of pusher 96. The flanges 96A and pusher 96 snap into cover 90 behind retention beads 96C inside cover 90 on each side thereof. Drawer 94 houses a spring 95, such as a generally rectangular stainless steel spring, which, via the pusher 96, drives candies C in the magazine 60 outwardly into the barrel 70 for appropriate discharge. Pusher retaining flanges 96A are captured by magazine retention beads 96C and protrude beyond the drawer to engage with beads 96C.

The magazine 60 also provides a transfer means or discharge barrel 70 for receiving candies C from the drawer, and for transferring candies downwardly through an opening 106 in the top shell 12. The barrel 70 is mounted to the magazine drawer 94 by a barrel yoke 102 defining a pair of openings 103 serving as an axis about which the barrel 70 may oscillate. Barrel 70 is provided with a pair of pivot posts 105 which are adapted to be received and retained in openings 103.

Barrel 70 comprises a hollow barrel body, a spring-loaded follower 112 and a spring 114 which allows follower 112 to be retracted inwardly. Follower 112 is retained against removal by legs 116 which engage formations internal of the barrel 70, thus limiting the extent to which follower 112 may project beyond the barrel, as may be seen from FIGS. 5 and 6.

Figure 5:
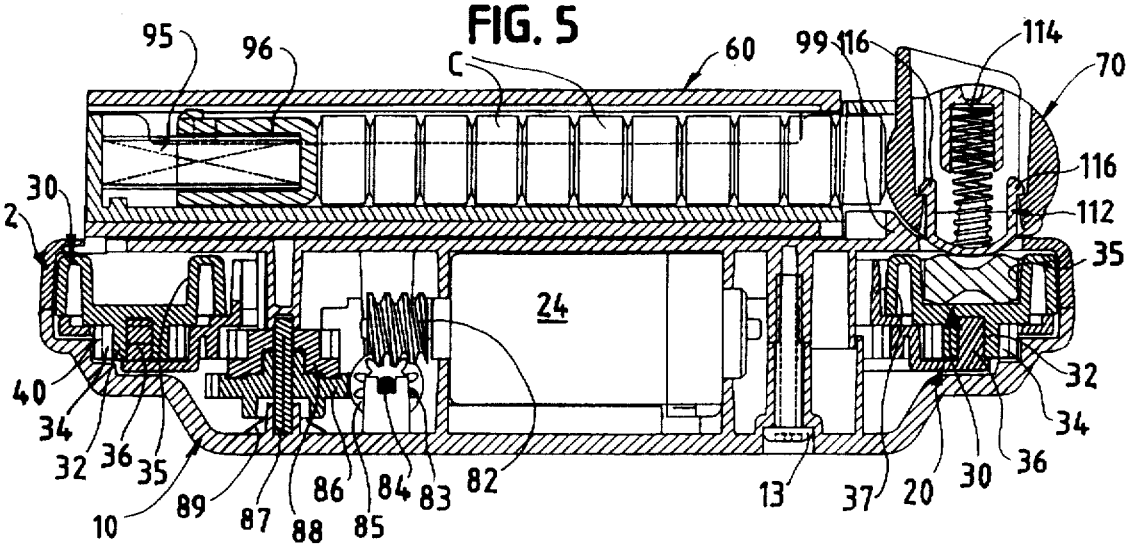
FIG. 5 is a cross-sectional view taken substantially along lines 5—5 of FIG. 7.
Figure 6:
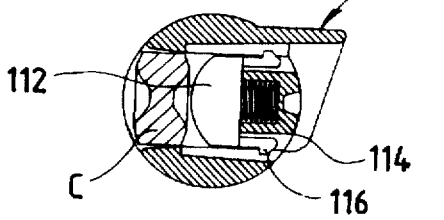
FIG. 6 is a fragmentary view of FIG. 5, but showing the barrel in a position to receive candies from a magazine.

As may be appreciated from FIGS. 5 and 6, when candies C are biased by spring 95 to the right within the magazine drawer 94 (as seen in FIG. 5), they will bear against an outer surface of barrel 70 when it is in the orientation of FIG. 5. At the same time, the follower 112 will force a candy in the barrel downwardly, through the barrel window 107 as seen in FIG. 3. At that time, assuming, as should be the case, that the compartment 35 in a turntable 30 is oriented properly to receive a candy C at the transfer station (directly below the barrel 70), the candy will be ejected into a compartment 35 to assume the position shown in FIG. 5. The candy will then be moved clockwise along the raceway and be rotated in a counterclockwise direction about its own axis from the transfer station for subsequent discharge at the discharge or ejection station.

When it is desired to transfer another candy from the magazine 60, the barrel 70 is pivoted from the position of FIG. 5 to that of FIG. 6. In that position, the spring loaded pusher 96 will force a candy C outwardly (to the right) against the force of barrel spring 114. At that point, a candy will be disposed within the barrel 70 (FIG. 6) and the barrel 70 may then be oscillated or rotated from the position of FIG. 6 to that of FIG. 5 for transfer of a candy C to the next available turntable 30. Guide 99 on the shell 12 assists in the smooth transfer of the candy from the magazine.

Figure 2A:
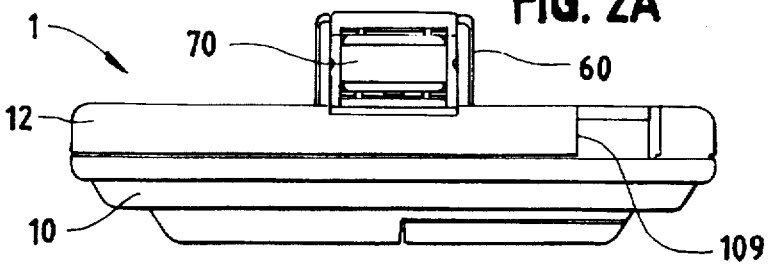
FIG. 2A is a side elevational view of FIG. 1 as viewed from the right side thereof.
Figure 2B:
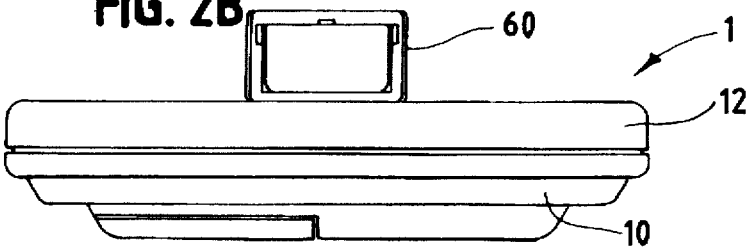
FIG. 2B is a side elevational view of FIG. 1 as viewed from the left side thereof.

The turntables 30 are assembled with the raceway 20 so that they have their compartments 35 perpendicular to the longitudinal axis of the magazine 60 when they are positioned immediately beneath the barrel 70. That is so that the candies may then be loaded into the compartments 35. Further at a second remote position of revolution of the raceway, at the ejection station where the candies are forced outwardly from a compartment 35 through a circumferential discharge opening or window 109 in the top shell wall (see FIGS. 1, 2A and 4), the compartments 35 are oriented so that the candies may be ejected radially of the dispenser 1.

The candies are ejected at an ejection station by a spring and cam mechanism as best illustrated in FIG. 4. As there seen an ejector tension spring 120 is seen to be mounted at one end 122 on a boss 123 in the shell. At its other end 121 spring 120 is secured to an L-shaped ejector 124. Ejector 124 is adapted to urge candies outwardly of the dispenser. Ejector 124 is mounted on pivot pin 119 and is adapted to oscillate thereabout. Pivot pin 119 is mounted in the top shell 12. The ejection end 127 of ejector 124 is aligned with the window 109 in the shell 12 and is adapted to be aligned with a turntable compartment 35. As the raceway 20 rotates clockwise relative to the fixed top shell 12, the ramps 126 on the raceway 20 force the ejector 124 inwardly of the shell, thereby stretching (tensioning) the spring 120. When the trailing edge 126A of the ramp 126 passes a point at which the ejector 124 bears against the ramp 126, the ejector will be thrust outwardly by the spring 120 to forcibly eject a candy in compartment 35 outwardly of the shell through side opening 109 in the shell wall.

Figure 7:
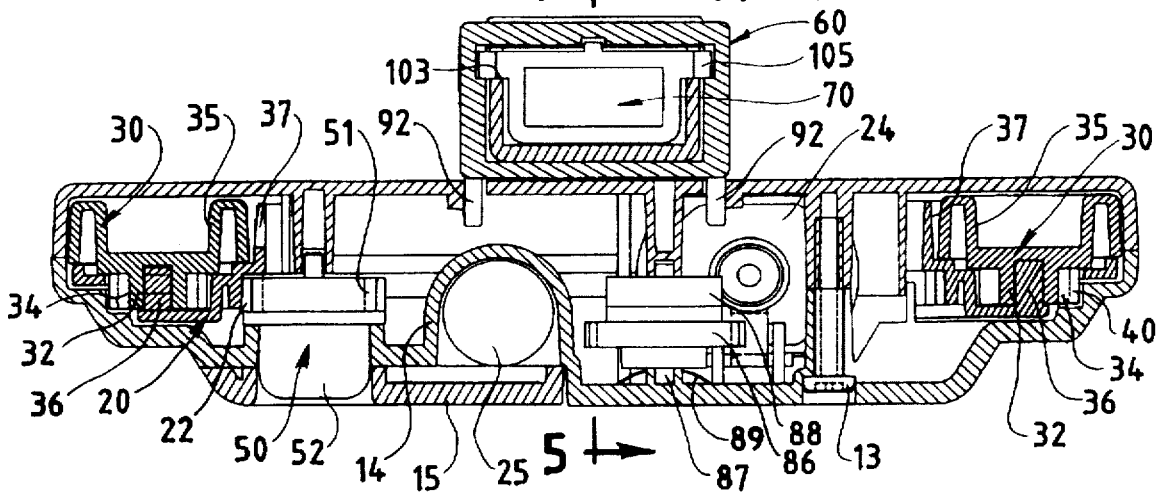
FIG. 7 is a cross-sectional view selectively taken through FIG. 4.
Figure 8:
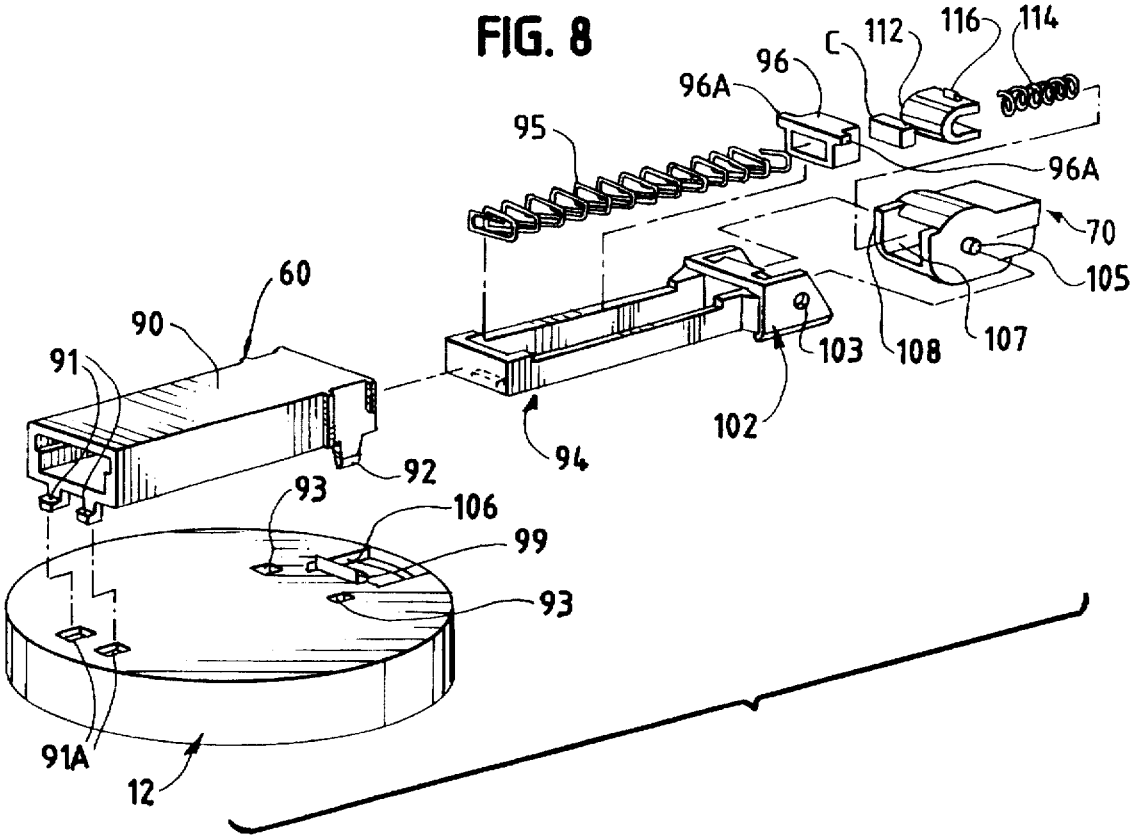
FIG. 8 is an enlarged view of a portion of FIG. 3 showing the exploded magazine assembly and its mode of securance to the top shell.
Figure 8A:
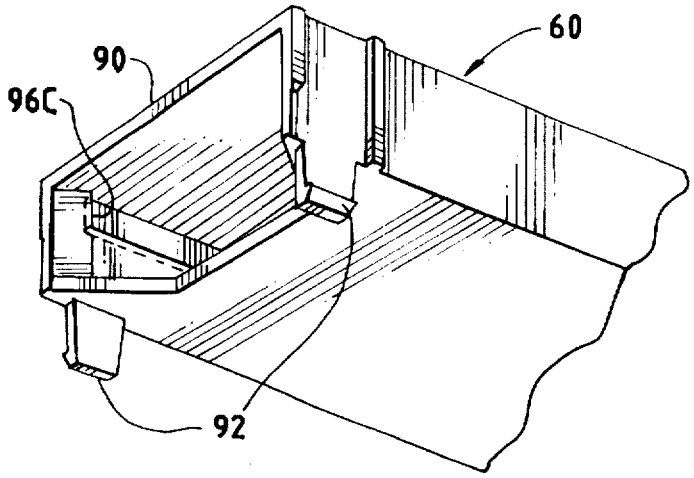
FIG. 8A is an enlarged bottom perspective view of a portion of FIG. 8.

As shown in FIGS. 4 and 7, an override knob 50 is provided. Override knob 50 has a flattened finger grip 52 and is formed with a circular outer gear 51 having teeth positioned to mesh with the teeth of gear 22. Knob 50 is located to freely rotate as the raceway 20 rotates relative to gear 22 as may be appreciated from the drawings. In the event that raceway 20 becomes "bound up" such that motor 24 will not drive it, it may be freed by manually gripping the flattened finger grip 52 and by rotating the override knob, thereby to manually drive the raceway sufficiently to free up the raceway for rotation once again by the motor 24 and gear train 26 via gear 22. Sufficient load on the override knob 50 will, as necessary, cause slippage between the pinion gear 88 and master gear 86.

Figure 9A:
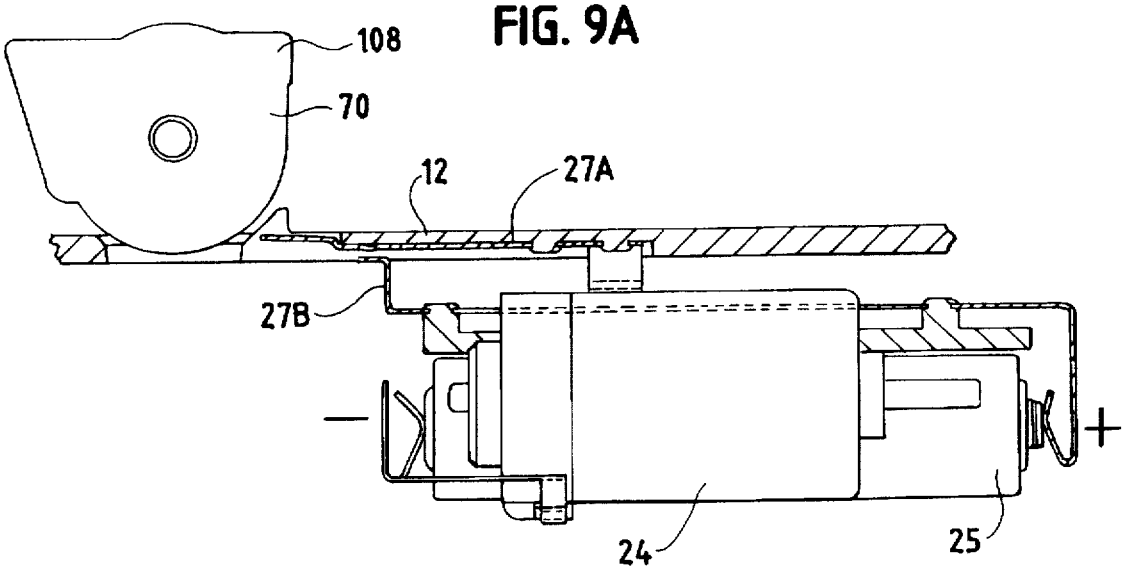
FIGS. 9A and 9B are schematic views showing how the leads to the battery are opened and closed via the barrel.
Figure 9B:
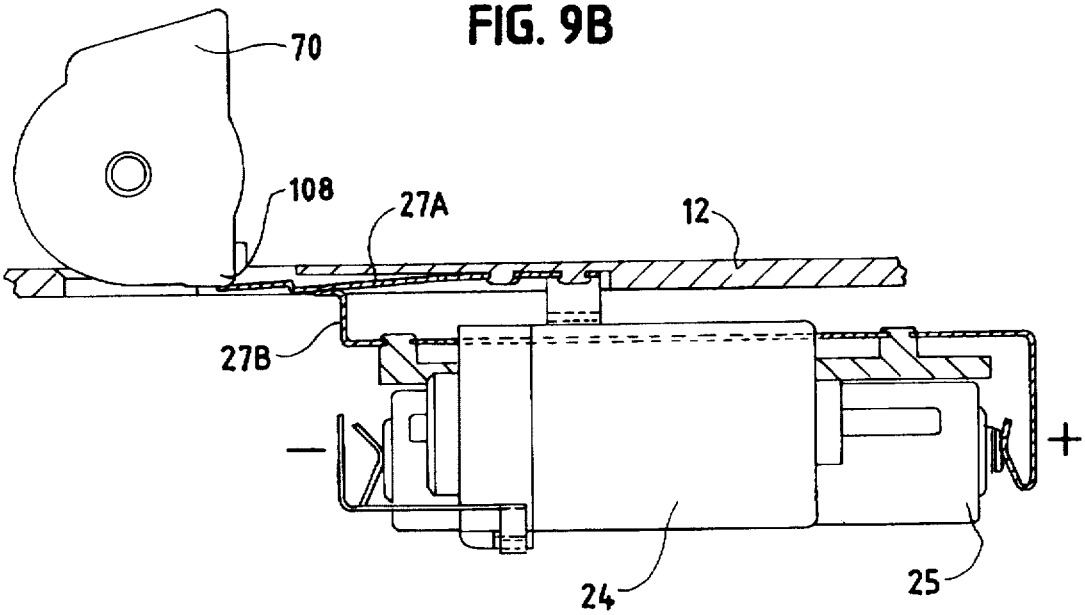

The motor may be supported on a suitable mounting plate. The battery is adapted to be supported between a pair of metallic contacts which in turn are in contact with the motor in a conventional manner. The motor is actuated by the protrusion or boss 108 on the barrel 70 which depends downwardly when the barrel is rotated, thereby to actuate a switch inside the top shell 12 which causes power from battery to be applied to the motor through suitable motor contacts. As shown by FIGS. 9A and 9B, as the boss moves from the inactive position of FIG. 9A to the active position of FIG. 9B, contact element 27A is forced into engagement with contact element 27B, closing a circuit to the motor 24 which is then powered by battery 25. Normally contacts 27A and 27B are out of contact with each other.

The gears, clutch elements, ejector, raceway and turntables may be of suitable injection molded plastics, such as of an acetal resin. The shells, battery cover, and mounting plate may be of an injection molded styrene plastic. The top shell is desirably transparent, while the bottom shell and its associated parts may be of suitably colored formulations. The magazine and barrel, as well as the pusher and follower may be of a molded styrene plastic as well. The battery contacts and motor contact may be of nickel plated cold rolled steel.

It will be apparent from the foregoing that a simple but dependable battery-operated, motorized dispenser has been provided. It may repeatedly and continuously dispense objects, such as generally rectangular candy objects, in prompt succession until the magazine is emptied, or may be operated intermittently to discharge only one object when that is desired. It dependably discharges the objects. Its construction is simple and its configuration minimizes any possibility of damaging the dispenser or objects to be dispensed. It is easily transportable. In a typical embodiment, dispenser 1 may be about four inches in diameter and about 1.5 inches in height. It may be made in attractive configurations and lends itself to a variety of color combinations, with transparent portions for viewing of the interior, such as for the top shell, and therefore has a significant amusement capability.

Although the dispenser 1 is specially configured for dispensing PEZ candies, it may also be used for other candy varieties as well. It is obvious that the components of the dispenser may need to be modified if the dimension and sizes of the objects to be dispensed so dictate.

From the foregoing, it will be apparent to those skilled in the art that modifications may be made without departing from the spirit and scope of the invention. Accordingly, it is not intended that the invention be limited except as may be necessary in view of the appended claims.

What is claimed is:

1. A hand held candy dispenser comprising:

a housing having a top and a bottom, said housing being adapted for receiving candies to be dispensed at a first station and defining a second station at which candies are to be dispensed from said housing, said housing top being transparent, a plurality of turntables in a single circular array disposed within said housing, each of said turntables including a compartment sized to accommodate a candy to be dispensed, said turntables being visible through said transparent top, and drive means operatively coupled to said turntables for continuously rotating said turntables and for continuously revolving said turntables within said housing as said candies are transported from said first station to said second dispensing station.

2. The dispenser of claim 1, wherein said housing comprises a bottom shell and a transparent top shell.

3. A dispenser comprising:

a housing for receiving objects to be dispensed and defining a station at which objects are to be dispensed from said housing, a plurality of turntables disposed within said housing, each of said turntables including a compartment sized to accommodate an object to be dispensed, and drive means operatively coupled to said turntables for rotating said turntables and for revolving said turntables within said housing to transport objects to said dispensing station, said housing comprising a bottom shell and a top shell, and wherein said drive means includes:

a first gear in said bottom shell, and a raceway mounted to revolve within said bottom shell, said raceway providing a second gear disposed about its inner periphery and providing means for rotatably mounting said turntables for engagement with said first gear.

4. The dispenser of claim 3, wherein the drive means further comprises:

a drive motor and a gear train having a drive gear engaging said first gear for revolving said raceway, and wherein said second gear imparts rotational motion to said turntables to rotate said turntables while the raceway revolves within said housing interior.

5. A motorized dispenser comprising:

a bottom shell having a first gear disposed about its interior periphery, a top shell mating with said bottom shell to define therewith a housing interior, the top shell having a magazine mounted to its exterior surface for communication with the housing interior, said top shell having a circumferentially located discharge opening therein, a plurality of turntables within said housing interior, each of the turntables including a compartment sized to accommodate an article to be dispensed, drive means operatively coupled to said turntables for imparting rotational motion to said turntables and for revolving said turntables within said housing interior, and a discharge mechanism that discharges the objects from said turntable compartments through said discharge opening when said associated turntable revolves to said-discharge opening.

6. The motorized dispenser of claim 5, and wherein said magazine is removeably mounted to said top shell.

7. The motorized dispenser of claim 6, and wherein said magazine includes a transfer means at a first end for transferring articles to said turntables.

8. The motorized candy dispenser of claim 5, wherein said drive means comprises:

a raceway mounted to revolve within said bottom shell, said raceway providing a second gear disposed about its inner periphery, and said raceway providing means rotatably mounting said turntables for engagement with said first gear.

9. The motorized dispenser of claim 8, wherein said drive means further comprises:

a drive motor and a gear train having a drive gear engaging said second gear for revolving said raceway, and wherein said first gear imparts rotational motion to said turntables to rotate said turntables while said raceway revolves within said housing interior.

10. A motorized dispenser for dispensing articles comprising a hollow housing defining a discharge opening, a raceway assembly enclosed within said housing, motor means for revolving said raceway within said housing, a plurality of turntables mounted on said raceway each said turntable defining a compartment for an article, means for rotating each said turntable relative to said raceway, means mounted to the outside of said housing for transferring articles into said housing and to said compartments at a first position of revolution of said raceway, and means for discharging articles from said compartments at a second position of revolution of said raceway which is remote from said first position.

11. The motorized dispenser of claim 10, and wherein said raceway assembly includes a first gear for engagement with said motor means for revolving said raceway assembly within said housing.

12. The motorized dispenser of claim 10, and wherein said means for rotating each said turntable includes a second gear in said housing, and each said turntable comprises a gear in engagement with said second gear.

13. The motorized dispenser of claim 10, and wherein said means for transferring articles includes a transfer barrel and a magazine, and wherein said magazine biases articles to said transfer barrel, and said transfer barrel is mounted to transfer articles received from said magazine downwardly into said housing and to said compartments.

14. The motorized dispenser of claim 13, and wherein said discharge opening is a window and said means for discharging articles from said compartments comprises a spring operated ejector for discharging articles through said window at said second position of revolution.

15. A motorized dispenser for dispensing articles comprising:

a hollow housing defining a discharge opening, a raceway assembly enclosed within said housing, motor means for revolving said raceway assembly within said housing, a plurality of turntables mounted on said raceway assembly, each said turntable defining a compartment for an article, means for rotating each said turntable relative to said raceway assembly, and means for forcibly ejecting articles serially from each said compartment, said means comprising spring means mounted in said hollow housing and means on said raceway assembly for biasing said spring means between a first inactive position and a second active ejecting position and for releasing said spring means to forcibly eject an article in said compartment from said housing.

16. The motorized dispenser of claim 15, and wherein said raceway assembly includes a first gear for engagement with said motor means for rotating said raceway assembly within said housing.

17. A hand held candy dispenser comprising:

a housing having a top and a bottom, said housing being adapted for receiving candies to be dispensed at a first station and defining a second station at which candies are to be dispensed from said housing, said housing top being transparent, a plurality of turntables in a single circular array disposed within said housing, each of said turntables including a compartment sized to accommodate a candy to be dispensed, said turntables being visible through said transparent top, drive means operatively coupled to said turntables for continuously rotating said turntables and for continuously revolving said turntables within said housing as said candies are transported from said first station to said dispensing station, and means for transferring candies from the outside of said housing into said housing at said first station for transport to said second station.

18. The dispenser of claim 17, and wherein said transferring means is releasably secured to said housing.

19. The dispenser of claim 18, and wherein said transferring means comprises a magazine and a transfer barrel and said transfer barrel is mounted on said housing to transfer candies received from said magazine downwardly into said housing and into said turntables.

* * * * *